United States Patent [19]

Pujol-Barcons

[11] Patent Number: 4,534,446

[45] Date of Patent: Aug. 13, 1985

[54] SYSTEM OF MOVABLE FOOTBRIDGES FOR THEIR USE IN THE CONSTRUCTION

[76] Inventor: Salvador Pujol-Barcons, Antonio Duenez Orozco 170, Cuidad Industrial, Terreon, Coah., Mexico

[21] Appl. No.: 563,667

[22] Filed: Dec. 20, 1983

[51] Int. Cl.[3] ..... E04G 3/14

[52] U.S. Cl. ..... 182/146; 182/82; 248/243

[58] Field of Search ..... 182/82, 148, 141, 146, 182/145; 248/235, 243, 244

[56] References Cited

U.S. PATENT DOCUMENTS

| | | | |
|---|---|---|---|
| 1,307,610 | 6/1919 | Yeagley | 182/148 |
| 1,442,075 | 1/1923 | Knechtel | 182/148 |
| 3,323,616 | 6/1967 | Best | 182/146 |
| 3,438,460 | 4/1969 | Solari | 182/146 |
| 3,548,970 | 12/1970 | Hutchens | 182/141 |

FOREIGN PATENT DOCUMENTS

| | | | |
|---|---|---|---|
| 150011 | 9/1920 | United Kingdom | 182/148 |

*Primary Examiner*—Reinaldo Machado
*Attorney, Agent, or Firm*—Ladas & Parry

[57] ABSTRACT

A moveable walkway which can be raised or lowered by workmen on the walkway is provided. The walkway runs on rails affixed to the side of the structure and comprises a sliding member fitting within hollow rails, which sliding member is filled with wheels having projections thereon for interacting with perforations in said rails and locking devices for stabilizing the walkway at any given level.

9 Claims, 13 Drawing Figures

SYSTEM OF MOVABLE FOOTBRIDGES FOR THEIR USE IN THE CONSTRUCTION

FIELD OF THE INVENTION

The present invention relates to walkways which can be raised up the sides of buildings and the like for use in construction or renovation of buildings and similar operations.

Hitherto the provision of walkways from which construction personnel may operate during the construction of buildings have normally required the assembly of very substantial scaffold structures. These traditional methods have required the expenditure of many man hours of effort in constructing a scaffold assembly which has to be carefully disassembled after the construction is complete. This is very wasteful. Furthermore, movement from one level to another is always difficult with traditional scaffold assemblies.

I have now devised a system which represents a major improvement over traditional methods.

It is an object of the present invention to provide a walkway which can be raised or lowered up the side of a construction by a simple operation of the workmen on the walkways themselves and yet which is sufficiently stable to be able to be used as a working platform. This is accomplished by affixing rails to the side of the structure and by having devices present on the walkway to enable the walkways to be raised or lowered up these rails by workmen present on the walkways.

SUMMARY OF THE INVENTION

Accordingly, the present invention provides a walkway system which comprises perforated rails fixed directly or indirectly to a structure and a walkway having mounted thereon manually operable elements cooperable with the perforations in said rails to cause the walkways to be raised or lowered on said rails and manually operable elements to secure said walkways at a desired position on the rails.

GENERAL DESCRIPTION OF THE INVENTION

Rails can be fixed to a structure in any convenient way. I have found that my new walkway system is of particular use in conjunction with the building system described in my copending application Ser. No. 537,500, filed Sept. 30, 1983 the contents of which are incorporated herein by reference. In this case, the rails of the present invention may, on occasion, be afixed to the mold structure used for the construction of the buildings.

Typically, rails for use in the present invention are metal profiles which are shaped so as to surround an open area and have a space along one side. Perforations are provided in the sall of the rail containing the space on both sides of the space or on the two "side walls" and also in the wall opposite that containing the space. Conveniently, the profile may have the cross section of a Greek cross with one limb thereof removed to provide the space.

The wall opposite that with the space is affixed to the building or possibly when the walkway is to be used in conjunction with the building system of my aforementioned to pending application, the mold assembly being constructed. Through the space in the opposite wall there is inserted the elevator apparatus of the walkway which comprises manually operable wheels containing projections or spokes extending from the wheels which cooperate with the perforations in the side wall of the rail. As an alternative, however, such wheels may be provided with an orientation in which they cooperate with perforations on the two side walls of the rail.

The walkways are also provided with manually operable latches which can cooperate with the perforations in the rails to stabilize the walkway at a desired height.

DESCRIPTION OF THE PREFERRED EMBODIMENT

The preferred embodiments of the invention will now be described with reference to the accompanying drawings where FIG. 1 is a partially cut away perspective view of the rails and the sliding element of a walkway.

Figure 1:
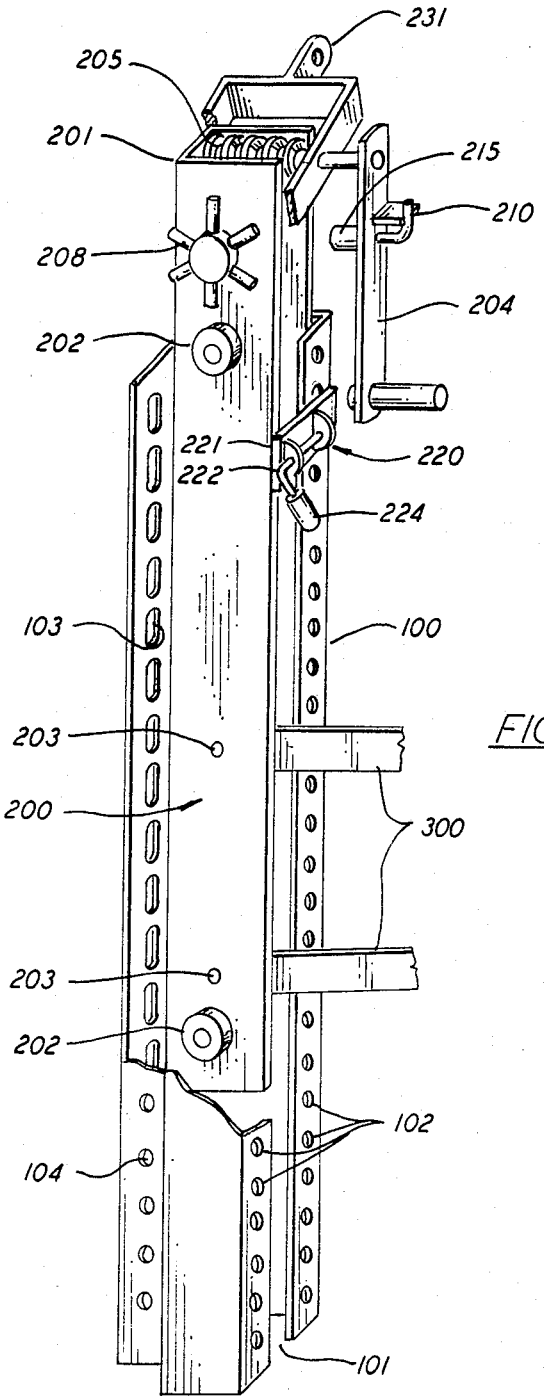
Figure 3:
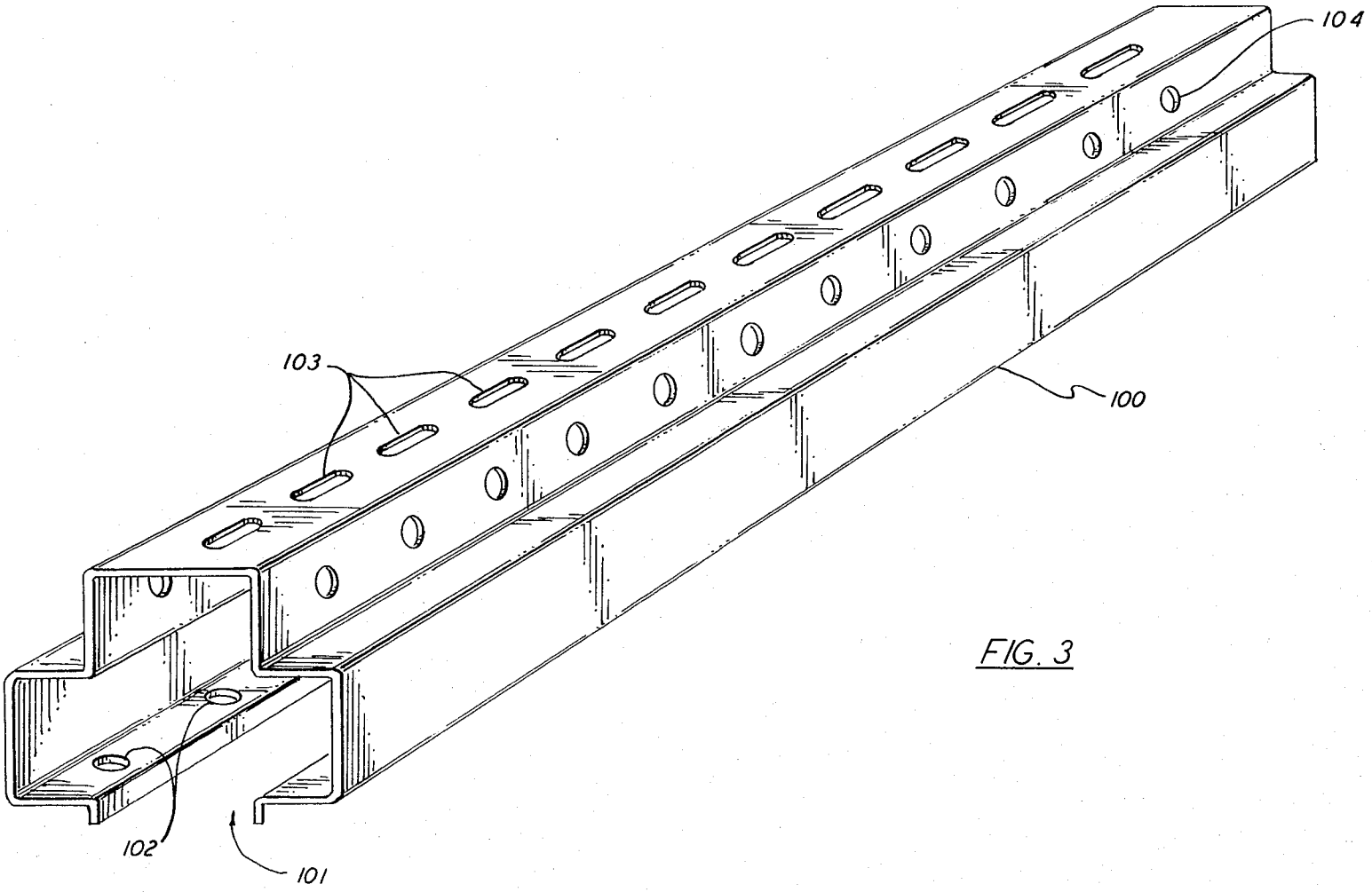
FIG. 3 shows a perspective view of a rail.
Figure 5:
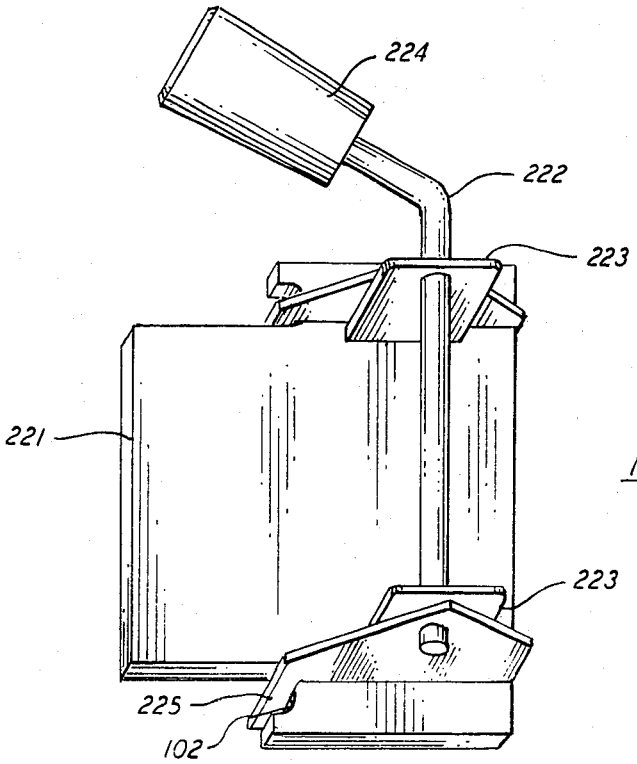
FIG. 5 is a perspective view of a latch used on the sliding element.
Figure 6:
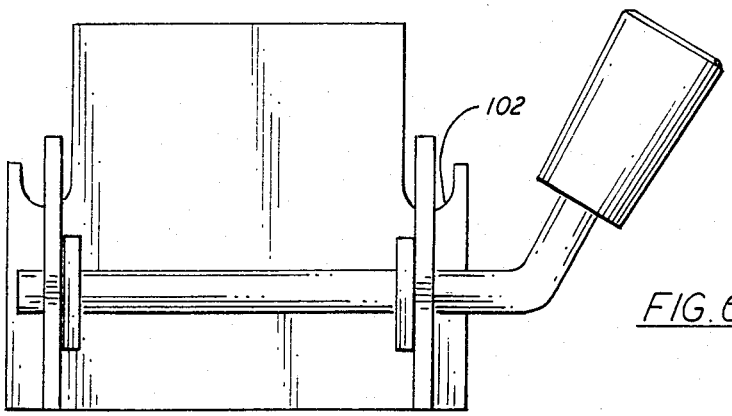
FIG. 6 is a plan view of the latch of FIG. 5.
Figure 8:
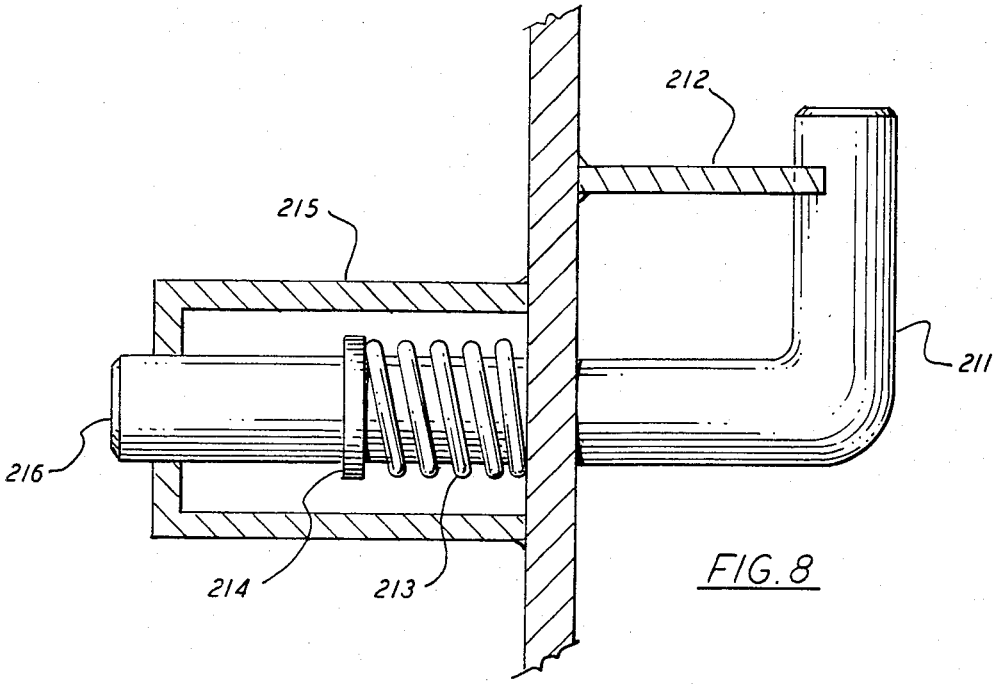
FIG. 8 is a cross section view of the handle latch used on the sliding element in its "retracted position".
Figure 9:
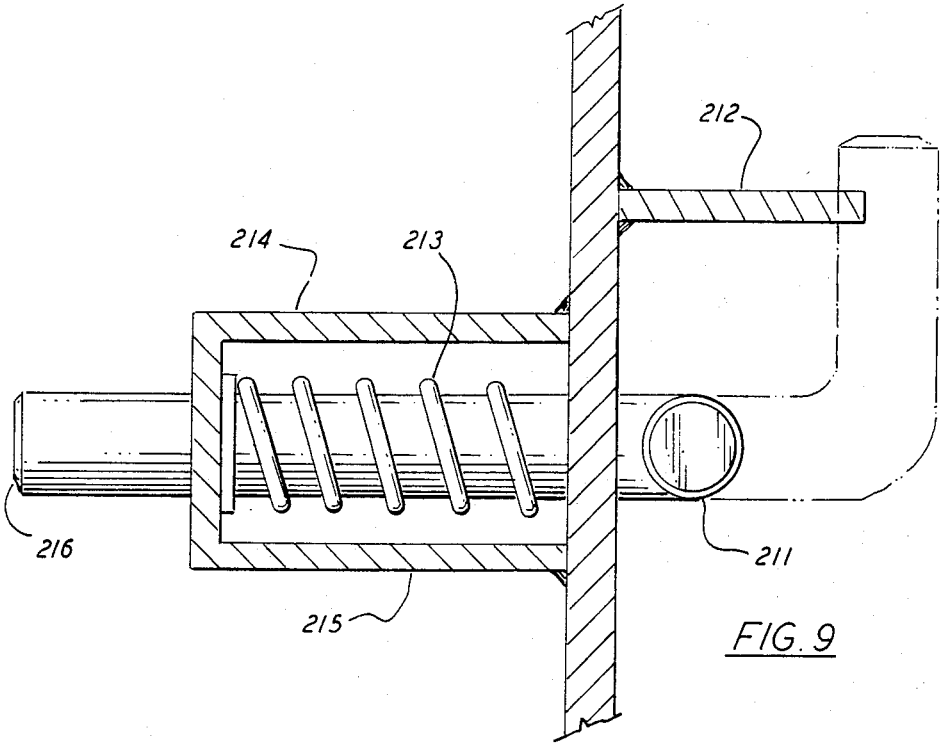
FIG. 9 is a cross section view of the handle latch used on the sliding element in its extended position.
Figure 10:
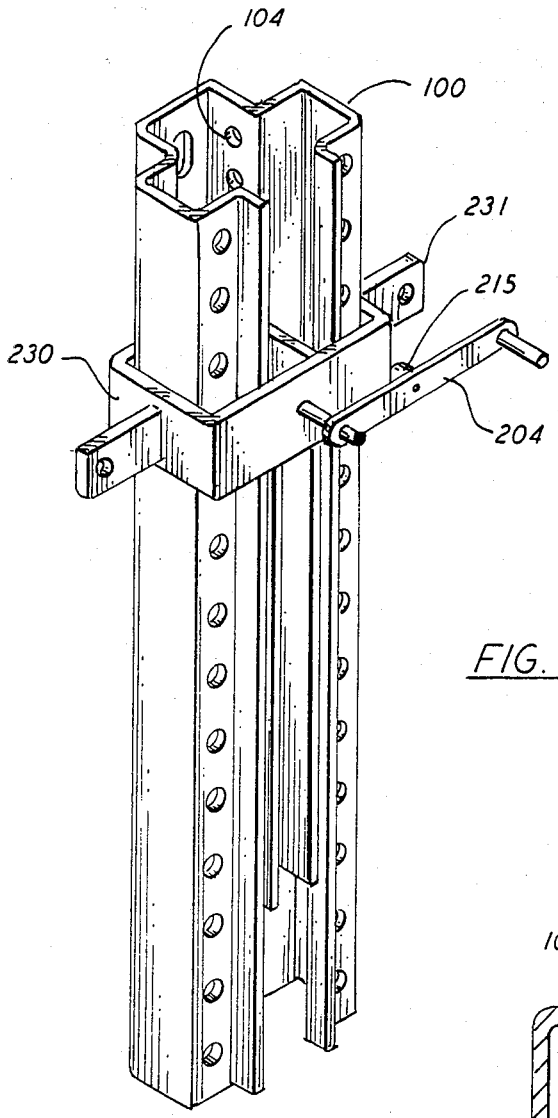
FIG. 10 is a perspective view showing the interrelation of the "ring" fail safe device.
Figure 11:
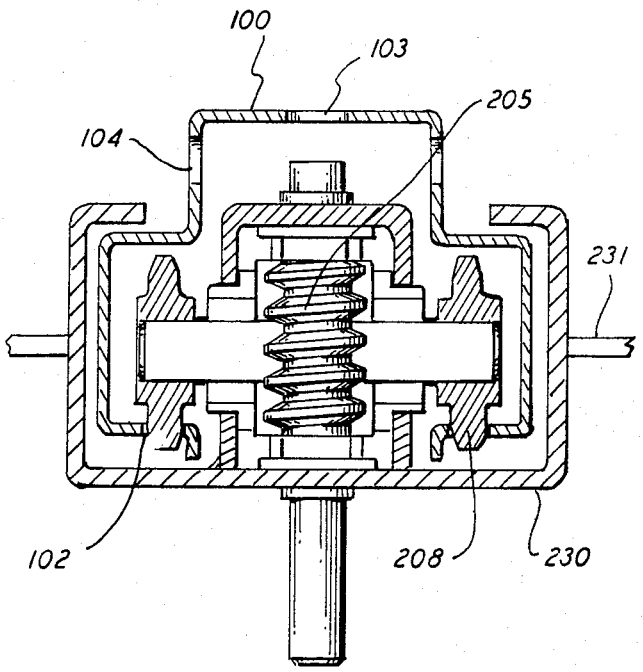
FIG. 11 is a horizontal cross section showing a cross section of the "ring" fail safe device.
Figure 12:
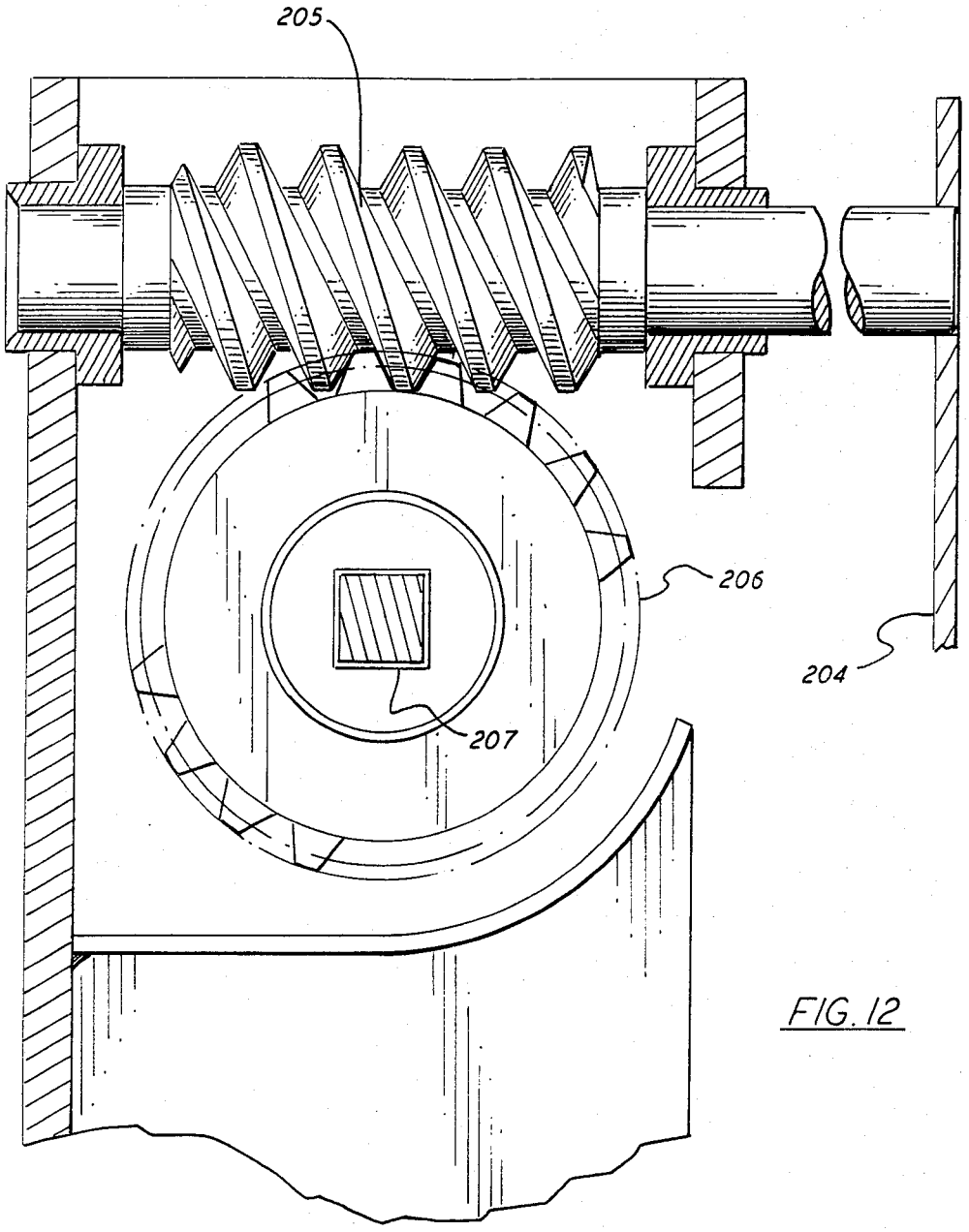
FIG. 12 is a vertical cross section of the gearing of the sliding element.

As shown in FIG. 1, the system of the present invention comprises a rail 100 which is a hollow profile the perimeter of which is essentially in the shape of a Greek cross having one limb removed. The rail is shown in more detail in FIG. 3. The missing limb of the Greek cross leaves a gap 101 in the rail. The positions of the profile on either side of the gap 101 are provided with perforations 102. The opposite side of the rail to the gap 101 is also provided with perforations 103, and the two sides adjacent to that wall are provided with perforations 104. The rails are typically attached to the structures on which the walkways are to be used by, for example, bolting them to the structure by bolts passing through the perforations 103. The rail is typically made of steel. The sliding element sits within the hollow in the interior of the rail profile 100. The sliding element 200 itself comprises a metal normally steel, profile 201 of a substantially "squared U-shape" configuration. To this profile are attached the supports for the walkway 300 (shown in more detail in FIGS. 4 and 13), the latch mechanism 220, 221, 222, 224, (shown in more detail in FIGS. 4, 5 and 6), a handle 204 which itself has mounted on it a further latch mechanism 211, 212, 213, 214, 215, 216 (shown in more detail in FIGS. 8 and 9), the ascent and descent mechanism 205, 206, 207 (shown in more detail in FIG. 12), guide rollers 202 and a guard ring 230.

The guide rollers 202 are mounted on an axle that perforates the profile base 201 of the sliding element. They are positioned so as to rotate against that position of the rail that contains the perforations 102 i.e. the "frontal" side of the rail and thereby to facilitate movement of the sliding element up and down the rail.

Two pins 203 also perforate the profile 201 and serve as fastening elements for the tubular or solid structure of support for the walkways 300.

The handle 204 actuates a worm drive 205 mounted on the profile 201 that cooperates with a crown gear 206 mounted on an axle 207 which is preferably of a non-cylindrical shape to avoid the sliding. The escalator wheels 208 are mounted on and actuated by the axle 207. The projections of the escalator wheels interact with the regular perforations 102 existing in the frontal side of the rail 100; with which will all move the part of the sliding element 200, and with it, the moveable walkway.

A latch 210 is positioned on the handle 204. This latch comprises a handle 211 which is moveable between a retracted and an extended position under the influence of spring 213. In its retracted position, the latch handle 211 is restrained by retainer 212. It may, however be released from the retainer by rotation and will then be urged into its extended position into the influence of the spring 313.

Also, fixed across the opening of the U of profile 201 is latch element 220. This element is in operation exterior to the rail 100.

The latch 200, normally consists of a laminar metallic base 221 joined to the body of the profile 201, on which is mounted an axle, that spins on two perforated platens 223 joined to the base 221. On one of the ends of the axle 222 is a counterweight 224 which actuates the same axle, moving at a direction toward the rail 100 so that two wedges 225, mounted on the axle 222 may be caused to penetrate through the perforations 102, thereby immobilizing the sliding and walkway.

The security ring 230 is fastened over the surface of the profile 201.

The solid or tubular structure of support 300 fastened to the sliding element 200 through which the pins 203, may be solid or tubular, of certain resistance, formed by elements that reinforce among each other, and on their opposite end 301 can have two perforated tubes, at a parallel direction to the sliding element 200 by which other tubes may go through 302, also perforated, which acting in a telescopic manner will serve to support and fix on them the elements of support 400 in the shape of a railing.

To fix the elements of support 400 between the solid tubular structures 301, 303 in a "U" shape with perforations 304 on their laterals and perforations 305 on their superior part are employed.

Through the perforations 304 and using a pin 306 along the perforations 307 on the solid tubular structure, the profile of "U" shape is joined to the structure 300, and the mentioned profile at the same time is joined to the elements of support 400 through the perforations 305, and the perforations 402.

The elements of support 400, to be fastened to the structure 300 as well as a zone of protection with railing, may be made of metallic sheet with end of profile shapes and perforations along its length, with the object of serving as a form of union on every dimension, at the same time that they prevent the sliding when used by the workers.

The several elements of support 400 are several perforated metal sheets joined together by screws.

The lowest element of the rail wherein the sliding element is mounted is affixed to a vertical wall of the structure to be constructed or repaired.

The rails, walkways and sliding elements of the present invention can all be assembled on site. The lowest element of the rail is attached to a vertical wall of the structure to be constructed or repaired and the support elements for the walkway 300 are attached by pins 203 to the sliding element 200. The sliding element is then inserted into the rail and the remainder of the walkway constructed. During the insertion of the sliding element into the rail, the projections on the escalator wheels 208 will interact with the perforations 102 in the rail 100. The handle 204 is rotated to turn the worm gear 205 in the "descent" direction so as to rotate the crown gear 206 and the escalator wheels 208 in the "descent" direction thereby permitting the interaction with the perforations. The spacing of the perforations 102 and the positions of the escalator wheel 208 and the dimensions of the projections thereon are chosen to permit the projections to pass through are perforation 102 and as rotation remain inserted in that perforation until the adjacent projection is fully inserted in the next perforation.

Figure 2:
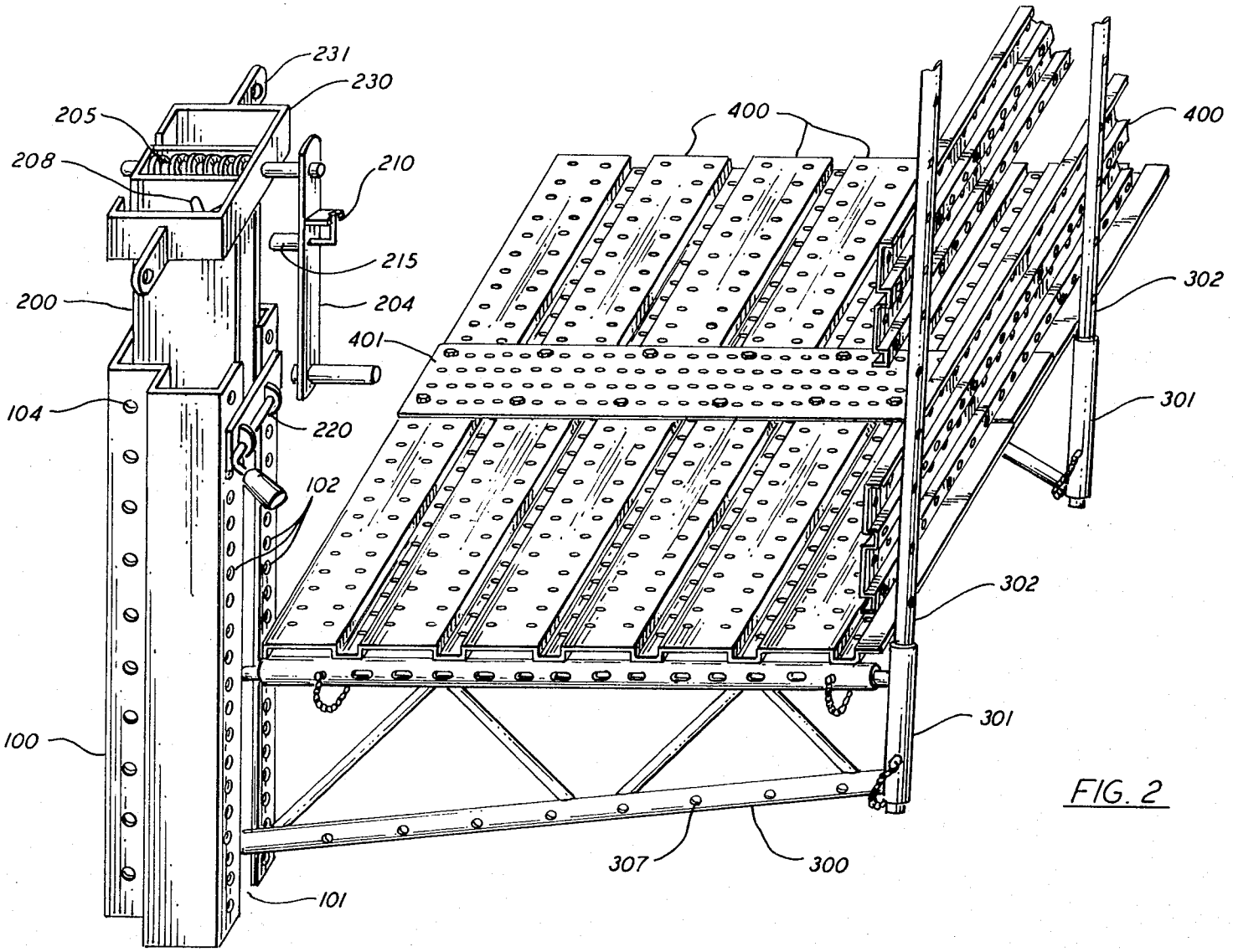
FIG. 2 is a perspective view of a walkway unit showing its mounting on the rails.
Figure 4:
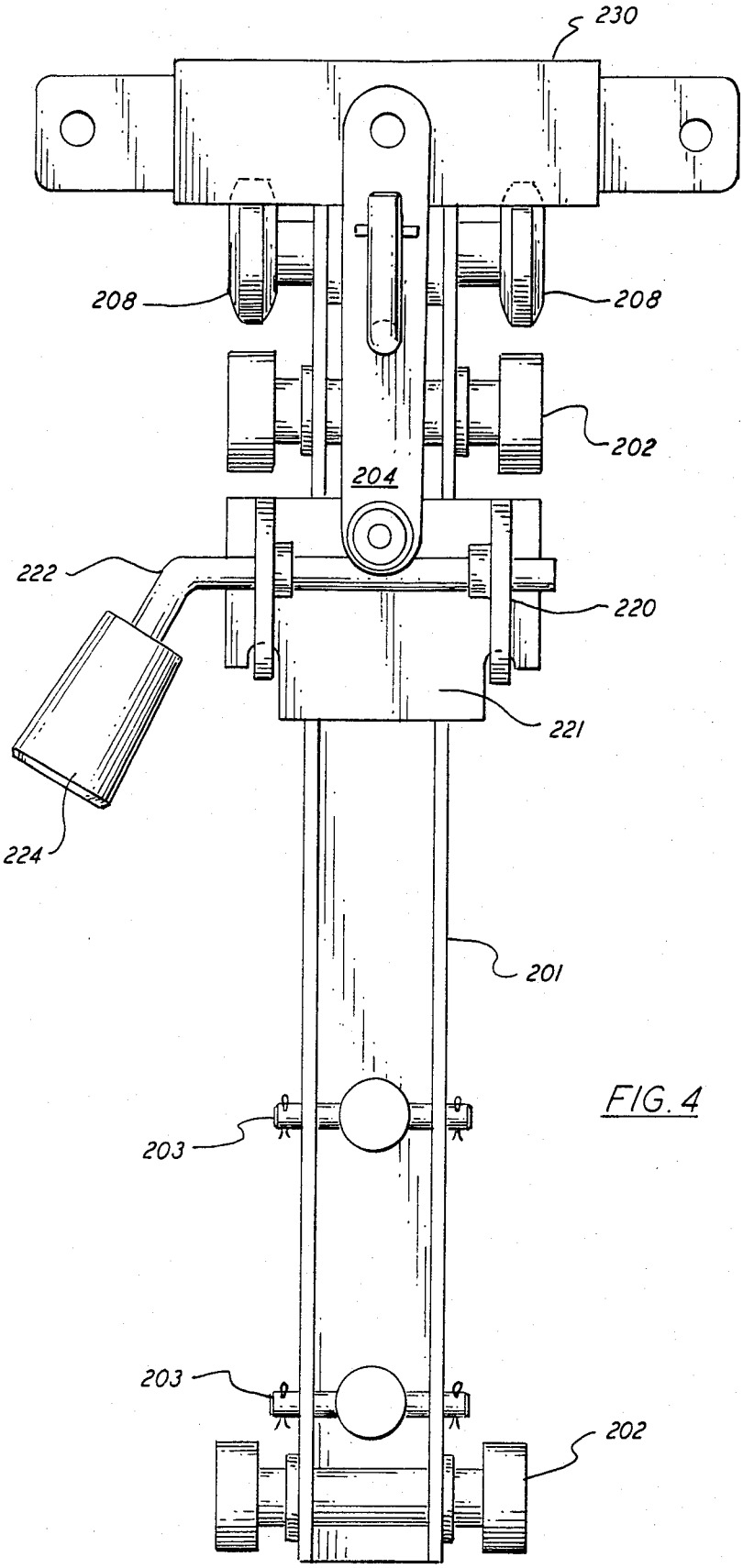
FIG. 4 is a vertical elevation of the sliding element used in this invention.
Figure 7:
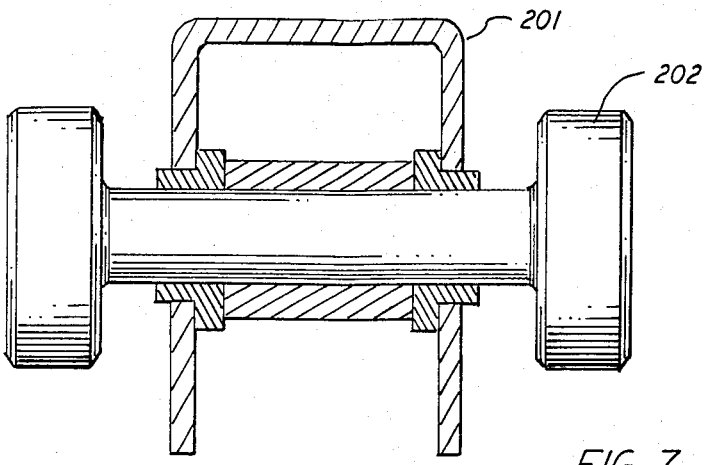
FIG. 7 is a cross section view of the roller mounting on the sliding element.
Figure 13:
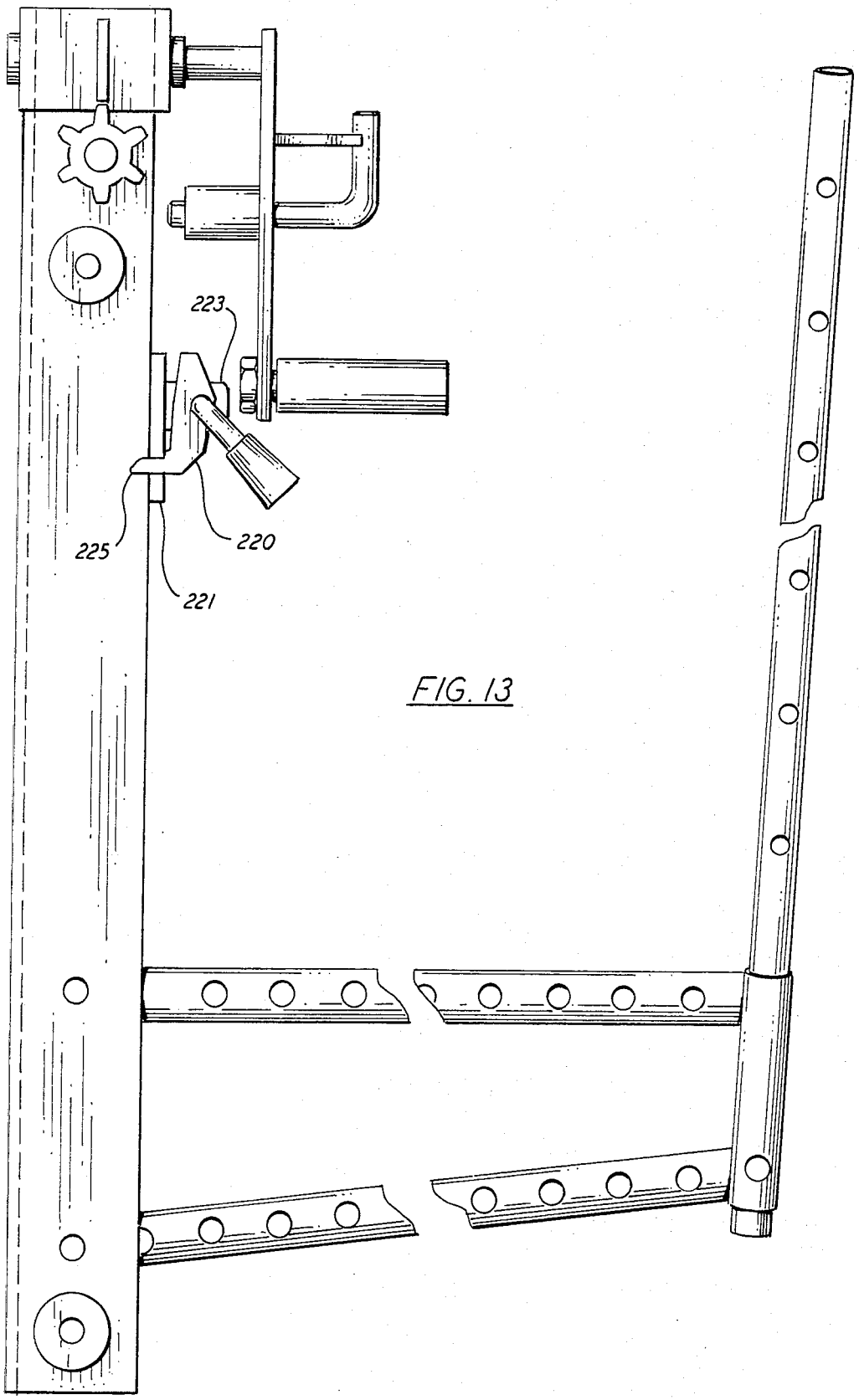
FIG. 13 is a side elevative view of the sliding element with the walkway attached.

The walkway 300 is assembled on the basis of the support members as shown in FIGS. 2, 4 and 13.

Having inserted the sliding element into the lowest of the rail units, the next length of rail may be positioned above and abutting with the first.

The walkway may then be caused to ascend the rails by rotation of the handle 204 in the opposite direction from from that in which it was turned during its introduction to the rails. The latch 220 is held "open" during the ascent by lefting the counterweight from its "rest" position. When a suitable height is attained the latch mechanisms are activated to prevent rotation of handle 204 by causing its latch handle 211 to be moved to its extended position thereby as a result of its interaction with the rails 100 preventing further rotation of the handle 204 until the latch handle is returned to its next position on the retainer 201 and activating latch 220 to cause its projections 225 pass through the holes 102 of the rails 100 thereby stabilizing the position of the walkway.

Once the walkway is stabilized, it can be used for building and the like operations or if desired as a platform from which further rails can be affixed to the structure so as to permit the walkway to be raised higher.

To lower the walkway the procedure is reversed.

What I claim is:

1. A walkway system which comprises perforated rails which may be fixed directed or indirectly to a structure wherein said rails comprise a substantially hollow profile with an opening along one side, said perforations in the rail being disposed at regular intervals on either side of said opening and a walkway wherein said walkway comprises a sliding element, the major part of which is disposed within said hollow profile, there being mounted on said profile escalator wheels having projections thereon which are cooperable with the perforations in the rail, said wheels being rotatable by a manually operable handle extending through the opening in the rails.

2. A walkway system as claimed in claim 1 wherein the rotary motion of the handle when this is rotated is transmitted to the escalator wheels by a worm and crown gear.

3. A walkway system according to claim 1 wherein the elements to secure the walkway in position comprises a latch mechanism wherein a pivotally mounted counter-weighted latch is urged to cooperate with perforations in the rail.

4. A walkway system according to claim 2 wherein a latch mechanism is provided wherein a pivotally mounted counter-weighted latch is urged to cooperate with perforations in the rail.

5. A walkway system according to claim 1 wherein the handle used for effecting rotation of the escalator wheels is further provided with a spring-loaded latch which will when the spring is released urge a projection of sufficient dimensions from the handle toward the rail to interact with the rail to prevent further rotation of the handle.

6. A walkway system according to claim 4 wherein the handle used for effecting rotation of the escalator wheels is further provided with a spring-loaded latch which will when the spring is released urge a projection from the handle of sufficient dimensions toward the rail to interact with the rail to prevent further rotation of the handle.

7. A walkway system according to claim 1 wherein said sliding element is provided with a guard ring which extends around the major portion of the rail and which will interfere with the rail if the rail deforms.

8. A walkway system according to claim 6 wherein said sliding element is provided with a guard ring which extends around the major portion of the rail and will interfere with the rail if the rail deforms.

9. A walkway system according to claim 8 wherein the sliding element is further provided with rollers to facilitate its movement on the rail.

* * * * *

UNITED STATES PATENT AND TRADEMARK OFFICE

CERTIFICATE OF CORRECTION

PATENT NO. : 4,534,446

DATED : August 13, 1985

INVENTOR(S) : Salvador Pujol Barcons

It is certified that error appears in the above-identified patent and that said Letters Patent is hereby corrected as shown below:

On the cover page the title should read:

-- Movable Walkway System of Use In the Construction Industry --.

Signed and Sealed this

*Seventh* Day of *January 1986*

[SEAL]

*Attest:*

DONALD J. QUIGG

*Attesting Officer*

*Commissioner of Patents and Trademarks*